US005199613A

United States Patent [19]

Magrath et al.

[11] Patent Number: 5,199,613

[45] Date of Patent: Apr. 6, 1993

[54] SMOOTH FLOW POUR SPOUT

[75] Inventors: Joseph M. Magrath, 1311 W. First St., McCook, Nebr. 69001; Mike L. Claeys, Golden, Colo.

[73] Assignee: Joseph M. Magrath, McCook, Nebr.

[21] Appl. No.: 795,512

[22] Filed: Nov. 21, 1991

[51] Int. Cl.[5] ..... B67D 5/32

[52] U.S. Cl. ..... 222/153; 222/541; 222/570; 285/921

[58] Field of Search ..... 222/153, 478, 479, 541, 222/570, 567, 569, 573, 485; 285/319, 921

[56] References Cited

U.S. PATENT DOCUMENTS

| | | | |
|---|---|---|---|
| 3,595,421 | 7/1971 | Sanchis | 222/479 X |
| 3,610,484 | 10/1971 | Matzka | 222/479 |
| 3,990,615 | 11/1976 | Kerwin et al. | 222/541 |
| 4,494,681 | 1/1985 | Ueda et al. | 222/541 X |
| 4,966,189 | 10/1990 | Harris | 285/319 |

FOREIGN PATENT DOCUMENTS

| | | | |
|---|---|---|---|
| 67589 | 3/1958 | France | 222/541 |
| 544089 | 6/1956 | Italy | 222/570 |

*Primary Examiner*—Andres Kashnikow
*Assistant Examiner*—Philippe Derakshani
*Attorney, Agent, or Firm*—Gregg I. Anderson

[57] ABSTRACT

A smooth pouring spout for attachment to a container having an opening in a upper wall thereof, has a device for locking and sealing the spout to the container. The pouring spout includes two component parts. A flat ring is adapted to surround the opening with the ring having radially inwardly directed flexible fingers and a spout member is insertable through the ring and the opening in the container to flex the fingers into a gripping relationship with a continuous edge of the container surrounding the opening. The spout member includes a large passage through which liquid can be removed from the container while air is introduced into the container through a smaller passage.

15 Claims, 2 Drawing Sheets

Fig_1
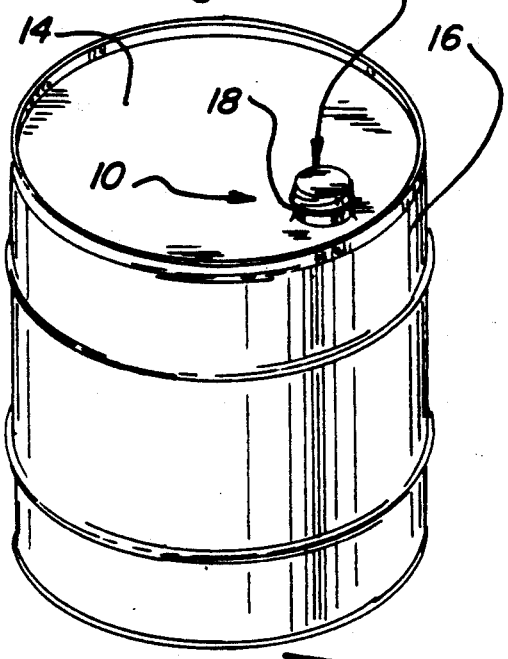
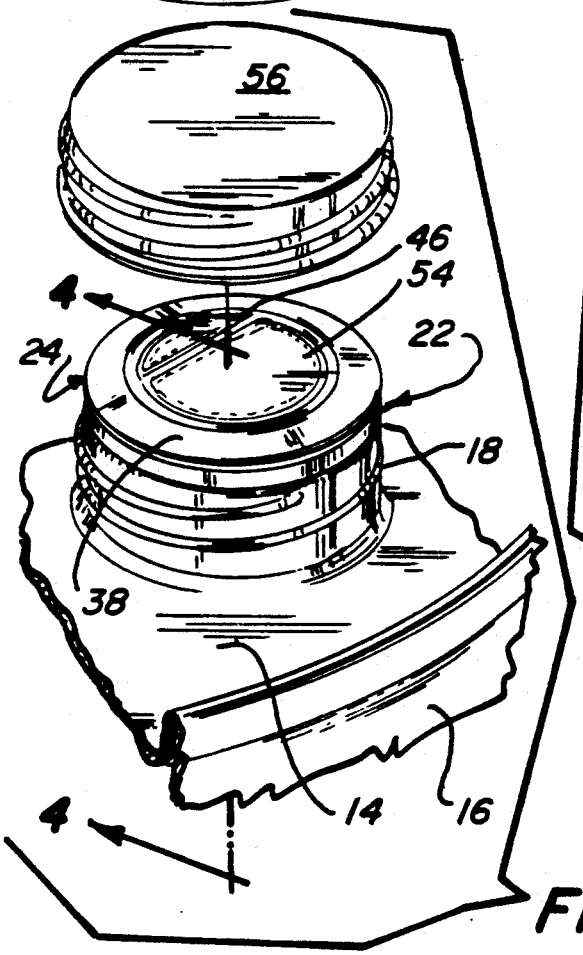
Fig_2
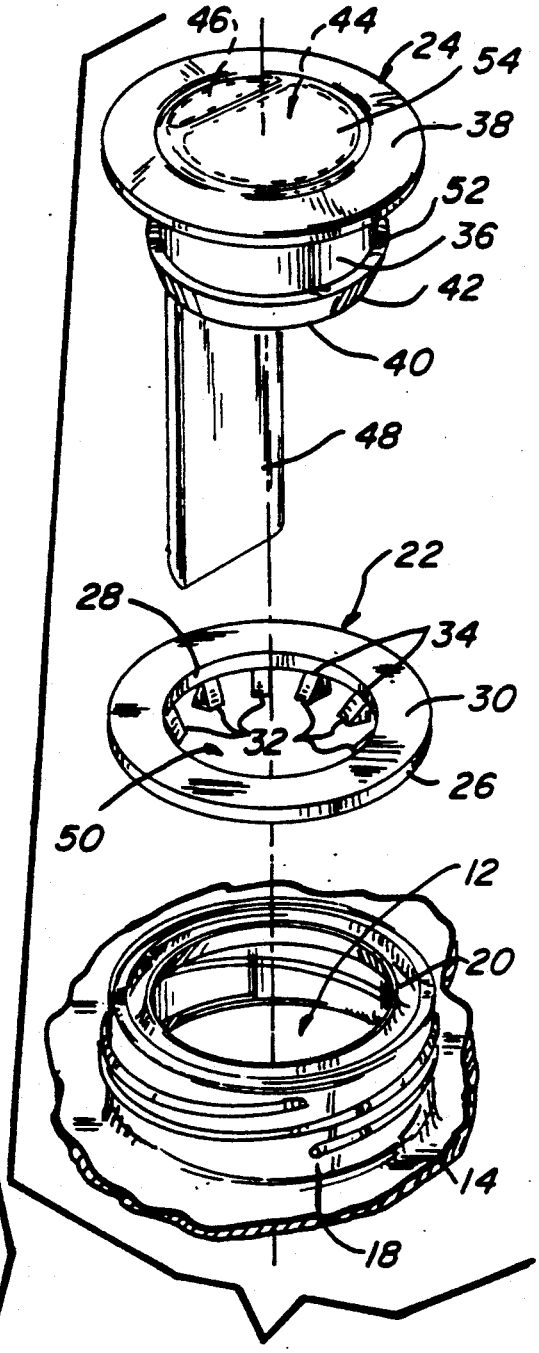
Fig_3

SMOOTH FLOW POUR SPOUT

BACKGROUND OF THE INVENTION

1. Field of the Invention

The present invention relates generally to pour spouts and more particularly to a pour spout adapted to be inserted into an opening in a liquid container so that liquids can be poured from the container in a smooth flowing manner.

2. Description of the Prior Art

It is many times difficult to pour a liquid smoothly from a container due to the fact that as the liquid is being removed from the container, air must be introduced to the container at the same rate and through the same opening to replace the liquid. Since the flow of the liquid and the air is interrupted by the counter currents of the two fluids, an irregular flow of liquid results. Not only does the irregular or uneven flow deter from the speed with which the liquid is removed from the container but it is also very annoying and sometimes messy as the liquid does not flow smoothly from the container. Rather, it lurches from the container in an intermittent pattern.

To overcome the drawbacks of irregular flow, numerous systems have been devised for incorporation into the opening of a container so that air is permitted to flow into the container at the same rate as liquid flows out. An example of such a device is disclosed in U.S. Pat. No. 2,812,113 issued to Beall, Jr. on Nov. 5, 1957. This device includes a central opening through which liquid can be poured and an outer elongated tubular member which protrudes a substantial distance into the container for permitting air to flow into the container as the liquid flows out. The invention is disclosed in several embodiments wherein the device can be screwed onto a threaded neck of a container or inserted in a friction fit manner into the opening from the container. A similar device defining a variation from that disclosed in the afore-noted Beall, Jr. patent is shown in another patent to Beall, Jr., U.S. Pat. No. 2,915,223, dated Dec. 1, 1959.

Another spout adapted to avoid uneven flow is shown in U.S. Pat. No. 2,796,205 issued to Kuzma on Jun. 18, 1957. In this device, there are two outlets from an insert that is frictionally inserted into the opening of a container, and each outlet has a curved tubular member connected thereto. The curved tubular members extend in opposite directions within the container so that according to the teaching in the patent, regardless of the angle of the container as liquid is being poured therefrom, air can be introduced to the container through one tube as the liquid is removed from the container through the other tube.

Other examples of pour spouts adapted to cooperate with containers to avoid irregular flow are disclosed in British Patent Specification No. 775,066 of Brune which was published May 15, 1957; U.S. Pat. No. 3,098,586 issued to Wasserberg on Jul. 23, 1963; and U.S. Pat. No. 3,595,421 issued to Sanchis on Jul. 27, 1971.

One noticeable drawback with the pour spouts disclosed in the prior art is the fact that they have been designed for use in bottle-type containers having elongated necks so that the spout can be inserted a substantial distance into the neck of the container and be structurally retained therein by the relatively long cylindrical inner wall of the neck of the container. Other containers, such as many drum-type containers, do not have elongated necks through which the contents of the container can be poured, but rather are merely provided with an opening in the thin top wall of the container that usually has a short peripheral rim therearound. In such containers, an elongated cylindrical surface is not present for confining or gripping a pour spout that may be inserted therein, and accordingly, the pour spouts of the prior art are not felt to be satisfactory for use on many drum-type containers.

Further, none of the prior art pour spouts attach to the container to which they are fit in such a manner that the engagement is inaccessible from the outside. In effect, the attachments shown in the prior art do not lock the pour spout to the container.

Pouring liquids from many drum-type containers is subject to uneven flow, however, and accordingly, there is a need for a smooth pouring flow spout that is adapted to attach to openings in short necked containers so that liquids can be poured smoothly from the containers.

Prior art pour spouts do not include means for locking and sealing the pour spout to the container so that any effort to tamper with the contents is resisted or can be detected. The pour spout of the present invention is locked and sealed onto the container with a sealing membrane attached over a passage through which liquid flows. The pour spout remains sealed and locked onto the container until it is ready to be used.

It is to satisfy the needs herein defined and to overcome the shortcomings in the prior art that the present invention has been developed.

SUMMARY OF THE INVENTION

It is the principal object of the present invention to provide a pour spout for a liquid container which locks onto the container.

It is a related object of the present invention to provide a pour spout through which liquid flows smoothly, without ingesting air as the liquid is poured.

It is another object of the present invention to provide a pour spout for a liquid container that is visually sealed to reduce the possibility of tampering with the contents prior to use.

The pour spout of the present invention is primarily adapted for use with containers having relatively short necks around a pour opening provided therein. The pour spout is inserted into the pour opening of the container and locked into place on the container until the liquid contents are needed. The means for locking are internal to the container, and not readily accessible. The pour spout has a liquid passage that is sealed by an attached membrane to reduce the possibility of tampering with the contents.

The pour spout includes two component parts: (1) a flat ring adapted to overlie and surround the opening in the container with the ring including a plurality of radially inwardly directed flexible fingers and (2) a spout member having a body portion that is adapted to be inserted through the ring so as to engage the fingers and flex the fingers into a gripping relationship with the container while establishing a fluid tight seal with the ring. The ring defines means for locking and sealing the spout member to the container opening.

The main body of the spout member has a dual passage therethrough with one portion of the passage defining a liquid flow region and the other portion of the passage defining an airflow region. The airflow region is in communication with an elongated tubular member that is adapted to project into the container so that liquid can be poured from the container via the liquid flow region of the passage while air is allowed to be simultaneously introduced into the container through the airflow region of the passage.

The flexible fingers on the flat ring are of a configuration to bridge the space between a peripheral rim or short neck on the container surrounding the opening and the main body of the spout member so that a positive connection of the pour spout to the container is simultaneously established as the spout member is inserted through the flat ring.

Other aspects, features and details of the present invention can be more completely understood by reference to the following detailed description of a preferred embodiment, taken in conjunction with the drawings, and from the appended claims.

BRIEF DESCRIPTION OF THE DRAWINGS

FIG. 1 is a perspective view of a drum-type container having the pour spout of the present invention positioned therein.

FIG. 2 is an enlarged fragmentary perspective view of a portion of the drum-type container where its pour opening is located with the pour spout of the present invention positioned therein and a removable cap adapted to be threaded onto the container over the pour spout.

FIG. 3 is an isometric fragmentary exploded view of the pour spout of the present invention and the pour opening in the top of the drum-type container of FIG. 1.

DESCRIPTION OF THE PREFERRED EMBODIMENT

Figure 4:
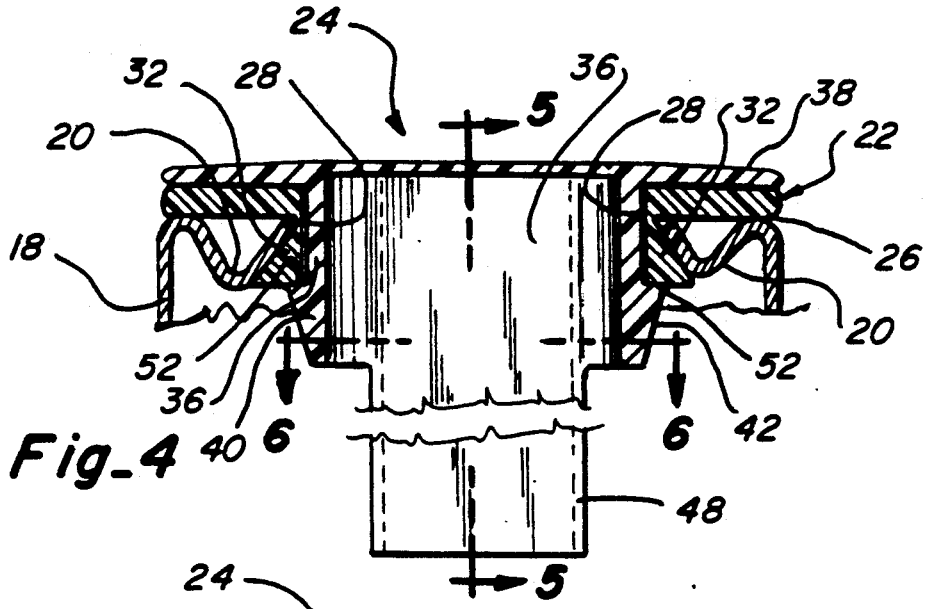
FIG. 4 is a section taken along line 4—4 of FIG. 2.

The pour spout 10 of the present invention can be seen in FIGS. 1 through 5 and 7 incorporated into a circular opening 12 provided through a relatively thin upper wall 14 of a drum-type container 16. The pour spout 10 locked and sealed to the container 16 at the opening 12 by means to be described hereinafter. Liquid stored in the container 16 is poured through the pour spout 10. Prior to use of the pour spout 10, the pour spout 10 is closed by a membrane 54 to reduce the possibility of tampering with the liquid contents of the container 16.

The opening 12 in the drum-type container 16 can be seen to be circular and defined by a radially inwardly directly peripheral edge or neck 18. The neck 18 is relatively short and has a downwardly convex curved surface 20 which, as will be appreciated with the description that follows, forms a surface against which the pour spout 10 of the present invention can be engaged to positively seat the pour spout in the opening 12. The neck 18 also includes external threads for a reason to be described hereafter.

The pour spout 10 includes two component parts, namely a flat ring 22 adapted to be seated on the upper wall 14 of the container in surrounding relationship with the opening 12 of the container, and a spout member 24 adapted to be inserted through the ring 22 with the spout member 24 providing means through which liquid can be poured from the container 16 while air is simultaneously introduced into the container 16. The flat ring 22 and the spout member 24 define means for locking and sealing the pour spout 10 to the container 16 about the opening 12.

Looking more specifically at FIG. 3, the flat ring 22 can be seen to have an outer circular peripheral edge 26 and an inner circular peripheral edge 28 with a relatively flat circular body 30 defined therebetween. A plurality of radially inwardly directed circumferentially spaced fingers 32 are flexibly and pivotally connected to the inner peripheral edge 28 of the flat ring by a living hinge 34. Each finger 32 is triangular in cross-section for a purpose to become more clear with the description that follows. The diameter of the inner peripheral edge 28 is substantially identical to the diameter of the opening 12 in the container 16 and the flat ring 22 is positionable in circumscribing alignment with the opening 12 in the container. The ring 22 is preferably made of a plastic material so that the fingers 32 can be connected to the inner peripheral edge 28 with a living hinge, but other suitable materials, such as soft metals, could also be used so long as the fingers could be flexed at their connection to the inner peripheral edge.

Figure 5:
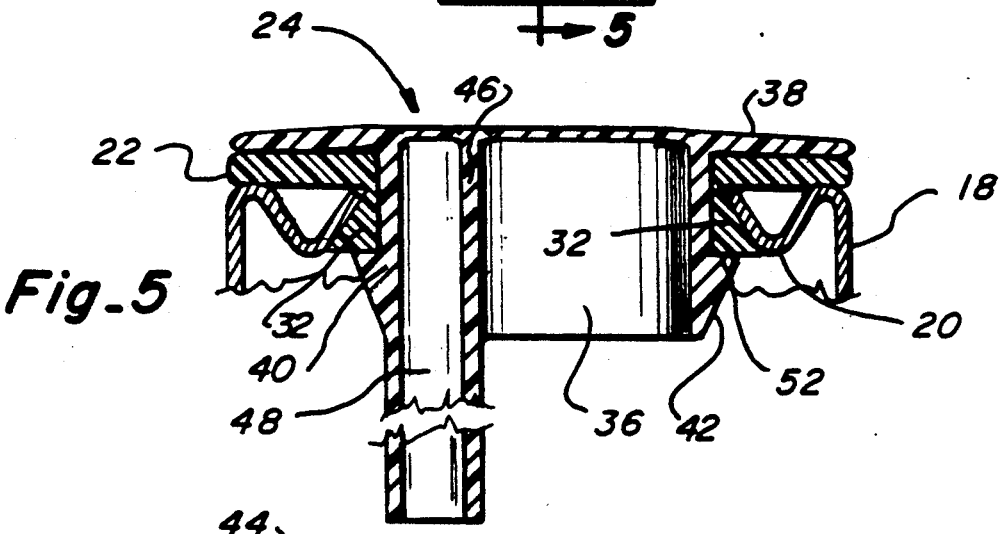
FIG. 5 is a section taken along line 5—5 of FIG. 4.

The spout member 24 includes a cylindrical main body 36 having an upper radially outwardly directed protrusion 38 and a lower radially outwardly directed protrusion 40. The upper radially outwardly directed protrusion 38, as can be seen in FIGS. 4 and 5, is slightly downwardly divergent. The lower radially outwardly directed protrusion 40 is of smaller diameter than the upper protrusion 38, but is slightly greater in diameter than the diameter of the cylindrical main body 36. The peripheral edge 42 of the lower protrusion 40 is beveled so as to define a downwardly converging frusto-conical surface for a purpose to be described later.

Figure 6:
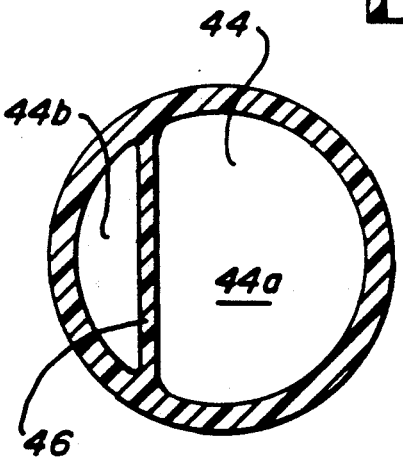
FIG. 6 is a section taken along line 6—6 of FIG. 4.

As best seen in FIGS. 3 and 6, the spout member 24 has a cylindrical passage 44 passing therethrough with the passage being divided into a large liquid flow region or passage 44*a* and a relatively small airflow region or passage 44*b* by a partition 46 forming a chord across the passage 44. The relatively small airflow region 44*b* of the passage 44 has an integral tubular extension 48 from the bottom end of the main body 36 which is adapted to extend a substantial distance into the container 16. As liquid flows from the container 16, the small airflow region 44*b* and the tubular extension 48 introduce air into the container 16. The result is a smooth flow of liquid out of the pour spout 10 without unnecessary ingestion of air.

The flat ring 22 and the spout member 24 are used cooperatively to be easily and positively connected to the container 16 in the opening 12 provided in the top wall thereof by first positioning the flat ring around the opening 12 so that the fingers 32 project substantially radially inwardly and into a circular space 50 defined by the inner peripheral edge 28 of the flat ring 22. The spout member 24 is then inserted into the circular space 50 by first inserting the tubular extension 48 from the main body into the space 50 and subsequently the lower radially directed protrusion 40 whose beveled frusto-conical surface 42 engages the circumferentially spaced fingers 32 and flexes the fingers downwardly and radially outwardly until they engage the curved surface 20 on the neck 18 of the container 16. Further insertion of the spout member 24 into the circular space 50 and through the flat ring 22 allows the upper radial protrusion 38 of the spout member 24 to engage the circular body 30 of the flat ring 22 simultaneously with the lower peripheral protrusion 40 passing beyond the flexible fingers 32 so that the fingers 32 become seated upon an annular shoulder 52 defined along the top surface of the lower peripheral protrusion 40.

By reference to FIGS. 4 and 5, it will be seen that once the spout member 24 has been fully inserted into the flat ring 22, the fingers 32 engage the main body 36 of the spout member 24 as well as the curved surface 20 on the neck 18 surrounding the opening in the container 16 to positively position the pour spout 10 in the opening. The flat ring 22 is pushed solidly against the neck 18 around the opening 12 in the container 16 in a fully sealed relationship therewith so that liquid in the container 16 cannot be removed therefrom without passing through the passage 44 in the main body 36.

Figure 7:
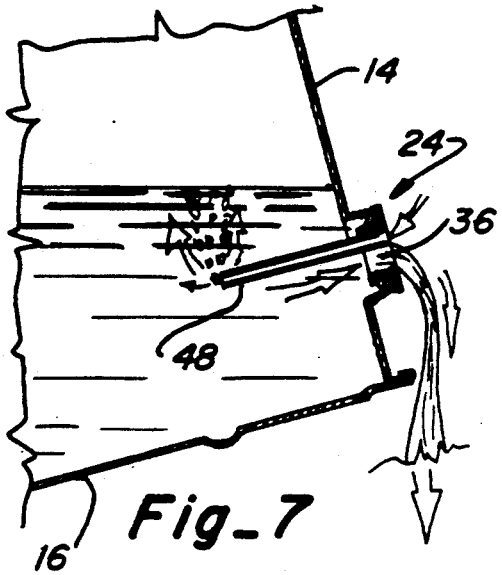
FIG. 7 is a fragmentary view of a portion of the drum-type container having been tilted so that liquid is shown being removed from the container through the pour spout while air is introduced into the container through the pour spout to replace the removed liquid.

As will be appreciated by reference to FIG. 1, the opening 12 in the container 16 is positioned near one side of the upper wall 14 of the container 16 and it is important when inserting the spout member 24 into the flat ring 22 that the smaller airflow region **44*b* of the passage 44 through the spout member 24 be closer to the center of the upper wall 14 of the container 16 than the larger liquid flow region 44*a*. In this manner and as can be seen in FIG. 7, when liquid is poured from the container 16 by positioning the pour spout 10 adjacent the lower side of the container 16 as it is tilted, air is introduced into the container 16 through the smaller airflow region 44*b* to allow the liquid to flow smoothly, without undesired ingestion of air from the container through the larger liquid flow region 44*a***.

It is anticipated that the pour spout 10 of the present invention will be incorporated into drum-type containers at a manufacturing site and, accordingly, the pour spout 10 includes the membrane 54 as part of a means for inhibiting tampering with the contents of the container 16. The thin membrane 54 overlies the cylindrical passage 44 of the spout member 24.

The engagement between the neck 18, the flat ring 22 and the spout member 24 is internal of the container 16 assists in limiting tampering. Once the pour spout 10 is inserted into the opening 12, it is locked in position and not readily removed from the container 16. The locking feature prevents easy removal of the pour spout 10 once it is inserted into the opening 12. In combination with the membrane 54, it is more difficult to tamper with the liquid contents of the container 16. The passage 44 is sealed so that liquid cannot be removed from the drum-type container 16 nor can foreign fluids or the like be introduced to the container 16.

Before use, the membrane 54 can easily be cut or pulled from the spout member 54 by either severing the membrane 54 along the peripheries of the liquid flow region **44*a* and the airflow region 44*b* or pulling the membrane 54 from the opening, if a releasable adhesive is used to connect the membrane 54 to the opening 12**.

It should also be noted that drum-type containers of the type illustrated typically include external threads on the neck 18 so that a removable and internally threaded cap 56 can be connected thereon. As will be appreciated from the above description of the pour spout 10, it fits snugly on the top of the neck 18 and, therefore, does not prevent the conventional cap 56 from being threaded onto the neck 18 over the pour spout 10.

As will be evident, a drum-type container which has the pour spout 10 of the present invention incorporated therein would also include the removable cap 56 so that to remove liquids from the container 16, it is merely necessary to threadedly remove the cap 56 and sever the tamper-resistant membrane 54 from the spout member 24. If the entire contents of the container are not removed at one time, the container 16 can be easily closed and sealed by threading the cap 56 directly over the pour spout 10 onto the neck 18.

Although the present invention has been described with a certain degree of particularity, it is understood that the present disclosure has been made by way of example, and changes in detail or structure may be made without departing from the spirit of the invention, as defined in the appended claims.

We claim:

1. A pour spout for use with containers having an opening defining a continuous edge to which said pour spout can be attached comprising in combination, a flat ring having inner and outer continuous peripheral edges, said inner peripheral edge surrounding a space which is alignable with said opening, a plurality of fingers flexibly attached to said internal edge, said ring adapted to overlie and engage said continuous edge of said container such that said fingers project at least partially into said space defined by said continuous internal peripheral edge, a spout member having a body portion of a cross sectional size and configuration slightly smaller than that of said space, said body portion being of hollow construction to define a passage therethrough, a first radially outwardly directed peripheral protrusion from one end of said body portion, a second radially outwardly directed peripheral protrusion from the opposite end of said body portion, said second protrusion having a cross sectional size and configuration substantially similar to that of said space, the distance from said one end of said body portion to said opposite end of said body portion being substantially the same as the length of said fingers, whereby said spout member can be fully inserted into said space allowing said second protrusion to flex said fingers into gripping relationship with said continuous edge of said container and to grip said fingers such that said flat ring is positively positioned between said first and second protrusions.

2. The pour spout of claim 1 wherein said body portion further includes a divider extending across said passage to divide said passage into a liquid flow region and an airflow region whereby air can flow into said container through said airflow region as liquid flows out of said container through said liquid flow region.

3. The pour spout of claim 2 wherein said spout member further includes a tubular element secured to said body portion and forming an extension from said opposite end in alignment with said airflow region.

4. The pour spout of claim 1 wherein the outer edge of said second protrusion is bevelled to assist in flexing said fingers as said spout member is inserted into said space of the flat ring.

5. The pour spout of claim 1 wherein said fingers are of triangular cross section and remain in engagement with said continuous edge of said container as well as said body portion of said spout member when said spout member is fully inserted into said space of the flat ring.

6. The pour spout of claim 1 wherein said fingers are flexibly connected to said internal peripheral edge by a living hinge.

7. The pour spout of claim 1 wherein said first peripheral protrusion is tapered slightly toward said opposite end of said body portion.

8. The pour spout of claim 2 wherein said liquid flow region is larger than said airflow region.

9. The pour spout of claim 3 wherein said internal peripheral edge and said continuous edge are of circular configuration.

10. A pour spout for use with liquid containers having an opening defined therein, through which said opening said pour spout extends, comprising in combination:

a spout member having at least one longitudinally-extending passage formed therein for receiving liquid flow from said container, a body portion of said liquid flow passage insertable through said opening defined in said container and including a first radially outward-directed peripheral protrusion from one end of said body portion and a second radially outward-directed peripheral portion from the opposite end of said body portion; and means for locking said spout member to a continuous edge formed about said opening, including a ring adapted to overlay and engage said continuous edge and fingers projecting inwardly from said ring into the opening of said container, whereby said fingers are fixedly positioned between said body and the continuous edge of said container.

11. The invention as defined in claim 10 wherein said body portion further includes a divider extending across said passage to divide said passage into a liquid flow region and an air flow region whereby air can flow into said container through said air flow region as liquid flows out of said container through said liquid flow region.

12. The invention as defined in claim 11 wherein said spout member further includes a tubular element secured to said body portion and forming an extension from said opposite end in alignment with said air flow region.

13. The invention as defined in claim 10 wherein the outer edge of said second peripheral protrusion is beveled to assist in flexing said fingers as said spout member is inserted through said ring.

14. The invention as defined in claim 10 wherein said fingers are flexibly connected to an inner peripheral edge of said ring by a living hinge.

15. The invention as defined in claim 11 wherein said liquid flow region is larger than said air flow region.

* * * * *